US008777237B2

(12) United States Patent
Brittingham et al.

(10) Patent No.: US 8,777,237 B2
(45) Date of Patent: Jul. 15, 2014

(54) CONVERTIBLE CREEPER ASSEMBLY

(76) Inventors: Eric A. Brittingham, Clarkston, MI (US); Kevin D. Ferguson, Ortonville, MI (US)

( * ) Notice: Subject to any disclaimer, the term of this patent is extended or adjusted under 35 U.S.C. 154(b) by 0 days.

(21) Appl. No.: 13/545,502

(22) Filed: Jul. 10, 2012

(65) Prior Publication Data

US 2013/0020774 A1 Jan. 24, 2013

Related U.S. Application Data

(60) Provisional application No. 61/510,343, filed on Jul. 21, 2011.

(51) Int. Cl.
*B25H 5/00* (2006.01)

(52) U.S. Cl.
CPC ..... *B25H 5/00* (2013.01)
USPC ..... 280/32.6

(58) Field of Classification Search
USPC ..... 280/32.5–32.6, 87.05, 79.11, 79.2, 280/47.41, 47.18; 248/346.07, 108; 108/30, 108/65, 90, 147
See application file for complete search history.

(56) References Cited

U.S. PATENT DOCUMENTS

| | | | | |
|---|---|---|---|---|
| 4,895,380 | A * | 1/1990 | Brooks et al. | 280/32.6 |
| 4,957,302 | A | 9/1990 | Maxwell | |
| 5,261,725 | A | 11/1993 | Rudolph | |
| D398,124 | S * | 9/1998 | Schultz et al. | D34/23 |
| 6,425,590 | B1 * | 7/2002 | Whiteside et al. | 280/32.6 |
| 6,824,149 | B1 | 11/2004 | Whitlock et al. | |
| 7,025,421 | B1 | 4/2006 | Fowler et al. | |
| 7,070,289 | B2 * | 7/2006 | Sasaki et al. | 359/859 |
| 7,481,438 | B2 | 1/2009 | Hernandez | |
| 2005/0051980 | A1 * | 3/2005 | Melvin | 280/32.6 |
| 2008/0157492 | A1 | 7/2008 | Chaykin et al. | |
| 2009/0172883 | A1 * | 7/2009 | Benedict et al. | 5/620 |

FOREIGN PATENT DOCUMENTS

JP 10155595 A 6/1998

OTHER PUBLICATIONS

International Search Report, Application No. PCT/US2012/046009, Dated Jan. 10, 2013.
Written Opinion of the International Searching Authority, Application No. PCT/US2012/046009, Dated Jan. 10, 2013.

* cited by examiner

*Primary Examiner* — John Walters
*Assistant Examiner* — James Triggs
(74) *Attorney, Agent, or Firm* — MacMillan, Sobanski & Todd, LLC

(57) ABSTRACT

A creeper assembly is provided that includes a frame assembly supported on a plurality of wheels for movement along a support surface. The frame assembly includes a seat and a backrest that extends from the seat. The frame assembly is adjustable between a lowered lying position, wherein the seat and the backrest are in a horizontal position at a first height above the support surface, and a raised seated position, wherein the seat is in a horizontal position at a second height above the support surface and the backrest is inclined in an upright position relative to the seat. An actuator is provided on the frame assembly that is operable for adjusting the frame assembly between the lowered lying position and the raised seated position.

17 Claims, 6 Drawing Sheets

CONVERTIBLE CREEPER ASSEMBLY

CROSS-REFERENCE TO RELATED APPLICATIONS

This application claims the benefit of U.S. Provisional Application No. 61/510,343, filed Jul. 21, 2011, the disclosure of which is incorporated herein by reference.

BACKGROUND OF THE INVENTION

This invention relates in general to convertible creeper assemblies, such as can be used to support a person in a lying position or a seated position while performing work on a vehicle or other object. In particular, this invention relates to an improved structure for a convertible creeper assembly that is operable between a lowered lying position and a raised seated position while a person is supported thereon.

A creeper assembly, also referred to as a mechanic's creeper, is commonly used to support a person in a lying position a short height above the ground to facilitate work underneath a vehicle. A typical creeper assembly includes a frame assembly having a generally flat support surface. The frame assembly is typically supported on wheels to allow the person, who is supported in the lying position, to maneuver the creeper assembly relative to the vehicle.

Convertible creeper assemblies are also known to be adjustable between various positions such as, for example, a lowered lying position and a raised seated position. However, known convertible creeper assemblies are configured to be manually adjusted between the lowered lying position and the raised seated position when a person is not supported on the creeper assembly. As such, these creeper assemblies can be somewhat inconvenient to adjust between the various positions.

Thus, it is desirable to provide a convertible creeper assembly that is operable between a lowered lying position and a raised seated position while a person is supported thereon.

SUMMARY OF THE INVENTION

This invention relates to an improved structure for a convertible creeper assembly. The creeper assembly includes a frame assembly that is supported on a plurality of wheels for movement along a support surface. The frame assembly includes a seat and a backrest that extends from the seat. The frame assembly is adjustable between a lowered lying position, wherein the seat and the backrest are in a horizontal position at a first height above the support surface, and a raised seated position, wherein the seat is in a horizontal position at a second height above the support surface and the backrest is inclined in an upright position relative to the seat. An actuator is provided on the frame assembly that is operable for adjusting the frame assembly between the lowered lying position and the raised seated position.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
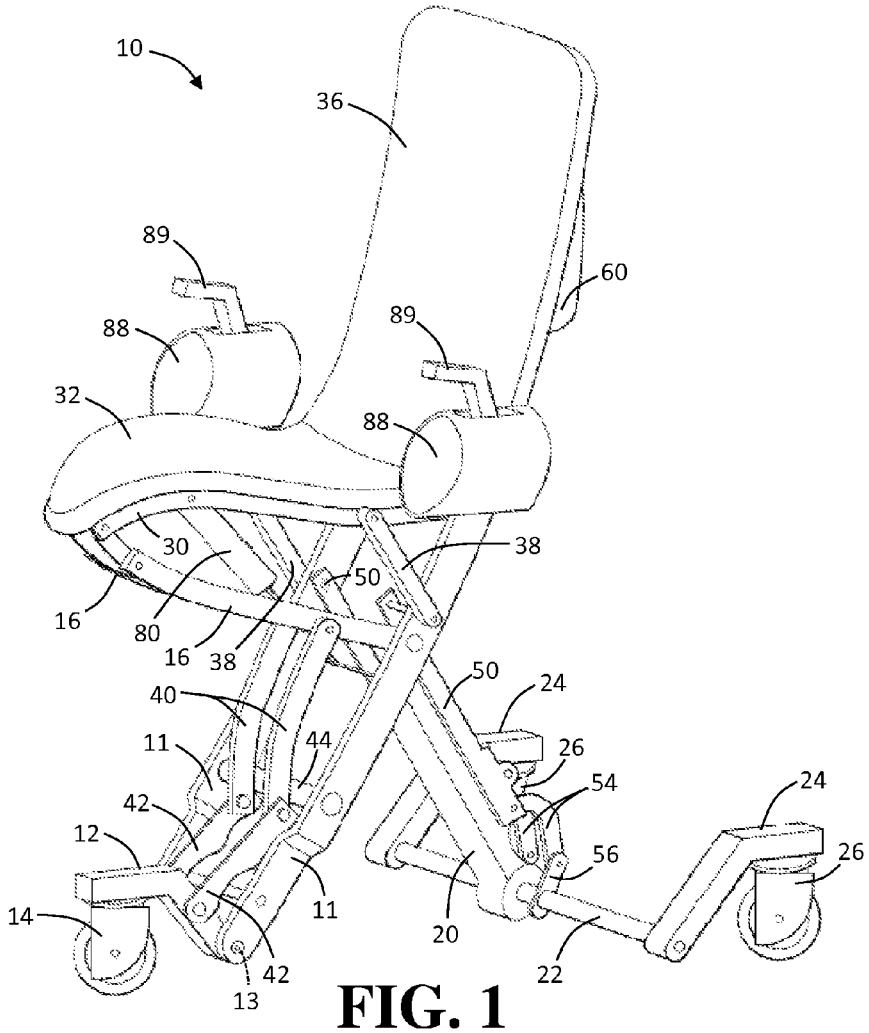
FIG. 1 is a perspective view of a convertible creeper assembly in a raised seated position in accordance with this invention.
Figure 2:
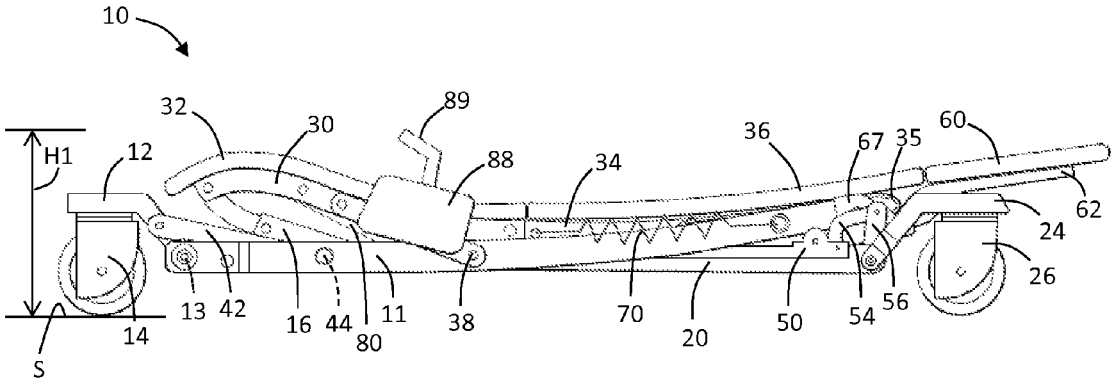
FIG. 2 is a side view of the creeper assembly illustrated in FIG. 1 in a lowered lying position.
Figure 3:
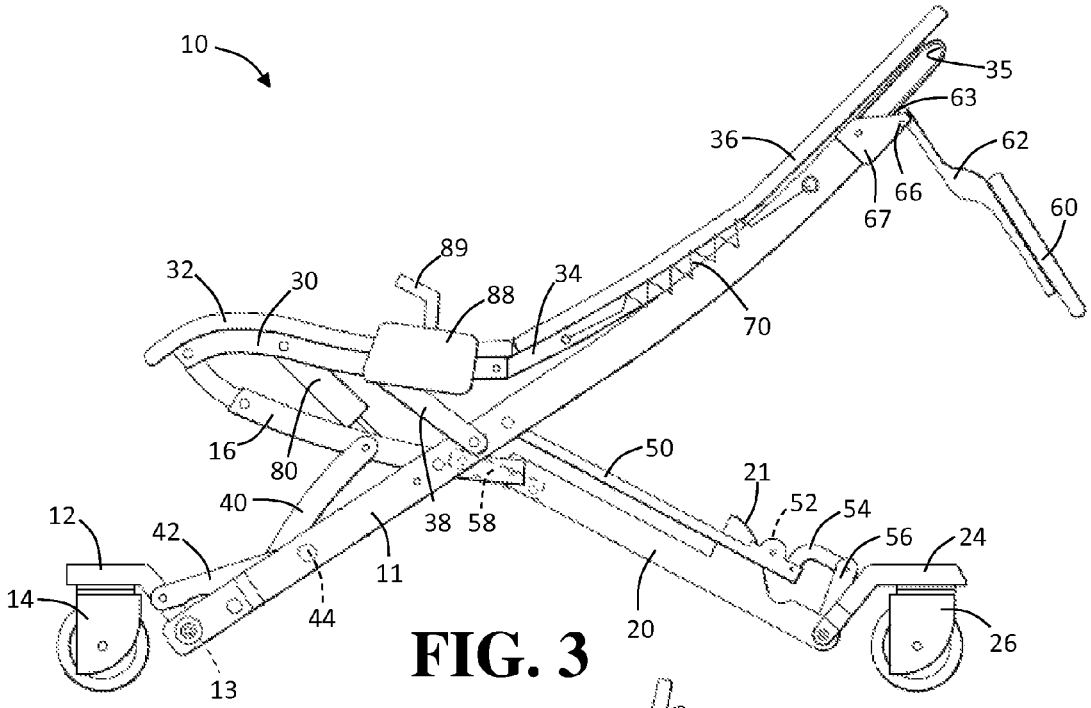
FIG. 3 is a side view of the creeper assembly illustrated in FIG. 1 in an intermediate position.

Referring now to the drawings, there is illustrated in FIG. 1 a convertible creeper assembly, indicated generally at 10, in accordance with this invention. As will be explained below, the illustrated creeper assembly 10 is adjustable between a lowered lying position (shown in FIG. 2), a raised seated position (shown in FIG. 4), or any intermediate position therebetween (such as shown in FIG. 3). In one example, the creeper assembly 10 can be used to support a person in various positions to facilitate work on vehicles or other objects. In another example, the creeper assembly 10 can be used to hoist a person to various positions to facilitate medical treatment on the person. It should be fully appreciated, however, that the creeper assembly 10 is not limited to the uses described herein but may be otherwise used in any desired environment and for any desired purpose.

As shown in FIG. 1, the creeper assembly 10 includes a pair of main support legs 11 that form a front support leg of the creeper assembly 10. The illustrated main support legs 11 are elongated members that are laterally spaced apart and parallel with one another. A front wheel support 12 is supported between first ends of the main support legs 11 by a front axle 13. The front axle 13 is rotatably supported between the main support legs 11, for example, by a pair of bearings such that the front wheel support 12 is pivotal relative to the main support legs 11, the purpose of which will be explained below. A caster wheel 14 is attached to the front wheel support 12. The caster wheel 14 can be any rotatable member that is configured to provide mobility to the creeper assembly 10. Also, the caster wheel 14 may alternatively be supported on the main support legs 11 in any other suitable manner.

The illustrated creeper assembly 10 also includes a pair of lower seat frame members 16. The illustrated lower seat frame members 16 are laterally spaced apart and parallel with one another. The lower seat frame members 16 are pivotally attached to a mid-section of the respective main support legs 11. As such, the main support legs 11 and the lower seat frame members 16 can be pivotal relative to one another.

Figure 4:
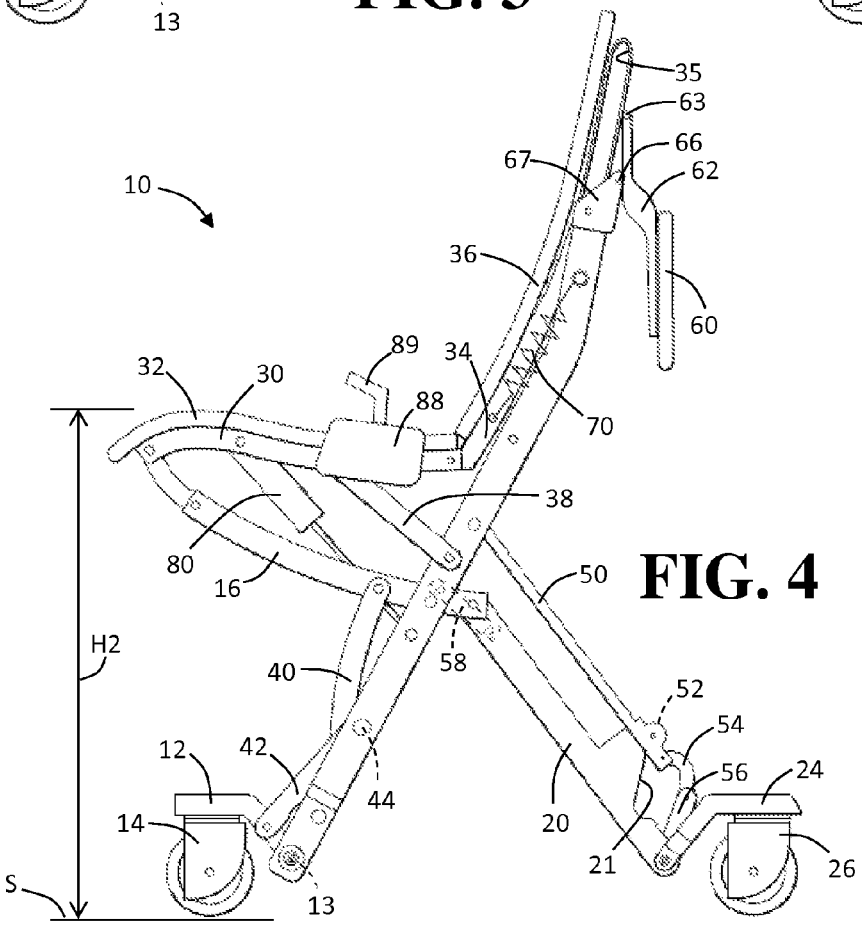
FIG. 4 is a side view of the creeper assembly illustrated in FIG. 1 in the raised seated position.

The illustrated creeper assembly 10 also includes a rear support leg 20. As shown in FIGS. 3 and 4, a first end of the rear support leg 20 is pivotally attached between end portions of the lower seat frame members 16. A rear cam surface 21 is provided along an upper surface of the rear support leg 20, although such is not required. The illustrated rear cam surface 21 is located near a second end of the rear support leg 20. The rear cam surface 21 defines a generally arcuate surface but, alternatively, may have any other shape. The purpose of the rear cam surface 21 will be explained below.

Referring back to FIG. 1, a rear axle 22 is supported on the second end of the rear support leg 20. The illustrated rear axle 22 is an elongated member that laterally extends in opposite directions from the second end of the rear support leg 20. The rear axle 22 can be supported on the second end of the rear support leg 20 by a bearing (not shown) or the like for rotation about a longitudinal axis thereof, the purpose of which will be explained below. As shown, the rear axle 22 includes rear wheel supports 24 that are respectively secured to opposite ends thereof. In turn, caster wheels 26 are attached to the respective rear wheel supports 24. The caster wheels 26 can be any rotatable members that are configured to provide mobility to the creeper assembly 10. Thus, the illustrated creeper assembly 10 is movably supported on three caster wheels 14 and 26. It should be appreciated, however, that the creeper assembly 10 may include any number or configuration of wheels as desired.

The illustrated creeper assembly 10 also includes a pair of upper seat frame members 30, although only one is shown. The illustrated upper seat frame members 30 are laterally spaced apart and parallel with one another. First ends of the upper seat frame members 30 are pivotally attached to the respective lower seat frame members 16. A seat 32 is secured along a top surface of the upper seat frame members 30 for supporting a person's lower torso. The seat 32 can be any size and shape as desired, and may include padding or other features for comfort and support.

As shown in FIGS. 3 and 4, the illustrated creeper assembly 10 also includes a pair of backrest support arms 34, although only one is shown. The illustrated backrest support arms 34 are laterally spaced apart and parallel with one another. First ends of the backrest support arms 34 are pivotally attached to the respective upper seat frame members 30. Second ends of the backrest support arms 34 define guide tracks 35, the purpose of which will be explained below. A backrest 36 is secured to the backrest support arms 34 for supporting a person's upper torso. As such, the backrest 36 can be any size and shape as desired, and may include padding or other features for comfort and support. The backrest portion of the creeper assembly 10 will be further described below.

Referring back to FIG. 1, the illustrated creeper assembly 10 also includes a pair of seat frame control arms 38. The illustrated seat frame control arms 38 are laterally spaced apart and parallel with one another. First ends of the seat frame control arms 38 are pivotally attached to the respective main support legs 11. Second ends of the seat frame control arms 38 are pivotally attached to the respective upper seat frame members 30 or any other member that is, in turn, secured to the upper seat frame members 30. The seat frame control arms 38 are configured to maintain the seat 32 in a horizontal position as the creeper assembly 10 is operated between the various positions. A horizontal position as used herein and below refers to a generally parallel orientation relative to a support surface S (as shown in FIGS. 2 and 4) on which the creeper assembly 10 is supported.

The illustrated creeper assembly 10 also includes a pair of front control arms 40. As will be explained below, the front control arms 40 are configured to maintain the front wheel support 12 in a horizontal position as the creeper assembly 10 is adjusted between the various positions. The illustrated front control arms 40 are laterally spaced apart and parallel to one another. First ends of the front control arms 40 are pivotally attached to the respective lower seat frame members 16 at a location that is spaced from the main support legs 11. A pair of front control arm links 42 is pivotally attached to the second ends of the respective front control arms 40. The front control arm links 42 are, in turn, pivotally attached to opposite sides of the front wheel support 12 at a location that is spaced from the front axle 13. The front control arms 40 and the front control arm links 42 are pivotal relative to one another to enable the creeper assembly 10 to maintain a relatively low profile in the lowered lying position, although such is not required.

A pair of front cam rollers 44 is respectively attached to each of the main support legs 11 and coaxially aligned with one another. As will be explained below, lower edges of the front control arms 40 ride along the front cam rollers 44 to control positioning of the front control arms 40. The creeper assembly 10 may, alternatively, include a single front control arm 40, front control arm link 42, and front cam roller 44 as opposed to a pair of each. In any event, these components will be collectively referred to as a front control arm mechanism, although the front control arm mechanism is not limited to the illustrated embodiment. The operation of the front control arm mechanism will be described below.

The creeper assembly 10 also includes a pair of rear control arms 50, although only one rear axle control arm 50 is shown. As will be explained below, the rear control arms 50 are configured to maintain the rear wheel supports 24 in a horizontal position as the creeper assembly 10 is adjusted between the various positions. The illustrated rear control arms 50 are laterally spaced apart and parallel with one another. First ends of the rear control arms 50 are pivotally attached to the respective main support legs 11 at a location that is spaced from the lower seat frame members 16. Alternatively, the rear control arms 50 can be pivotally attached to any other member that is, in turn, secured to the main support legs 11. A rear cam roller 52 is mounted between the rear control arms 50, the purpose of which will be explained below.

Second ends of the rear control arms 50 are pivotally attached to a pair of rear control arm links 54. Thus, the illustrated rear control arm links 54 are also laterally spaced apart and parallel with one another. The rear control arm links 54 are, in turn, pivotally attached to a pair of rear axle brackets 56, which are secured to the rear axle 22. It should be appreciated that the creeper assembly 10 may include a single rear control arm 50, rear control arm link 52, and rear axle bracket 56 as opposed to a pair of each. In any event, these components will be collectively referred to as a rear control arm mechanism, although the rear control arm mechanism is not limited to the illustrated embodiment. The operation of the rear control arm mechanism will be described below.

As shown in FIGS. 3 and 4, a rear support leg control arm 58 is provided between the rear support leg 20 and the main support legs 11, although such is not necessarily required. The rear support leg control arm 58 controls pivotal movement of the rear support leg 20 relative to the lower seat frame members 16. A first end of the rear support leg control arm 58 is pivotally attached between the main support legs 11 at a location that is spaced from the lower seat frame members 16. Alternatively, the rear support leg control arm 58 can be attached to any other member that is, in turn, secured to the main support legs 11. A second end of the rear support leg control arm 58 is pivotally attached to the rear support leg 20 at a location that is spaced from the lower seat frame members 16. Thus, when the creeper assembly 10 is in the raised seated position, as shown in FIG. 4, the rear support leg control arm 58 pivots the rear support leg 20 relative to the lower seat frame members 16 to provide added height to the creeper assembly 10.

The illustrated creeper assembly 10 also includes a headrest 60, although such is not required. The headrest 60 can be configured to support a person's head when the creeper assembly 10 is in the lowered lying position. As such, the headrest 60 may be any size and shape, and may include padding or other features for comfort and support. The illustrated headrest 60 is movable between an extended position and a retracted position. For example, the headrest 60 is in the extended position when the creeper assembly 10 is in the lowered lying position, as shown in FIG. 2. And the headrest 60 is in the retracted position when the creeper assembly 10 is in the raised seated position, as shown in FIG. 4. As will be explained below, the illustrated headrest 60 is automatically moved between the extended and retracted positions as the creeper assembly 10 is adjusted between the various positions. However, the headrest 60 can be selectively movable to any desired position independent of the position of the creeper assembly 10 if so desired.

As shown in FIGS. 3 and 4, the headrest 60 is secured to a headrest support arm 62. The headrest support arm 62 is, in turn, pivotally attached to the guide tracks 35 of the respective backrest support arms 34 by a hinge mechanism 63. A guide member 64 extends between the respective ends of the main support legs 11. The guide member 64 is supported within the guide tracks 35 for movement relative to the backrest support arms 34, the purpose of which will be explained below. The guide member 64 can be a cylindrical component that is rotatably supported between the main support legs 11, although such is not required. A cross bar 66 also extends between the main support legs 11. For example, the illustrated cross bar 66 is secured between a pair of brackets 67 that are, in turn, secured to the respective ends of the main support legs 11. The cross bar 66 is spaced from an outer surface of the guide tracks 35, the purpose of which will also be explained below. These components will be collectively referred to as an automatic headrest mechanism, although the automatic headrest mechanism is not limited to the illustrated embodiment. The operation of the headrest mechanism will be described below.

Referring now to FIGS. 2 through 4, the creeper assembly 10 may include a pair of spring members 70, although only one spring member is shown. The spring members 70 are configured to bias the creeper assembly 10 in the raised seated position, thereby reducing the amount of work that is needed to raise the creeper assembly 10 to the seated position when a person is supported thereon. For example, the illustrated spring members 70 are connected at their first ends to an upper portion of the respective main support legs 11 and at their second ends to a lower portion of the respective backrest support arms 34. Thus, the spring members 70 bias the respective backrest support arms 34 and the upper seat frame members 30 in the upward direction relative to the main support legs 11. It should be fully appreciated that the creeper assembly 10 may include any number or configuration of spring members or similar components to bias the creeper assembly 10 in the raised seated position.

The illustrated creeper assembly 10 also includes an actuator 80. The actuator 80 is a drive mechanism that is configured to raise and lower the creeper assembly 10 between the various positions. In the illustrated embodiment, for example, the actuator 80 is preferably a hydraulic actuator but alternatively may be a pneumatic actuator, an electric actuator, or any other mechanism that is configured to raise and lower the creeper assembly 10. A first end of the illustrated actuator 80 is pivotally attached to the upper seat frame members 22. A second end of the illustrated actuator 80 is pivotally attached to the main support legs 11 or any other member that is, in turn, secured to the main support legs 11. The actuator 80 may alternatively be attached to any other members of the creeper assembly 10 so as to adjust the creeper assembly 10 between the various positions. Further, the creeper assembly 10 may include any number or configuration of actuators 80.

Figure 14:
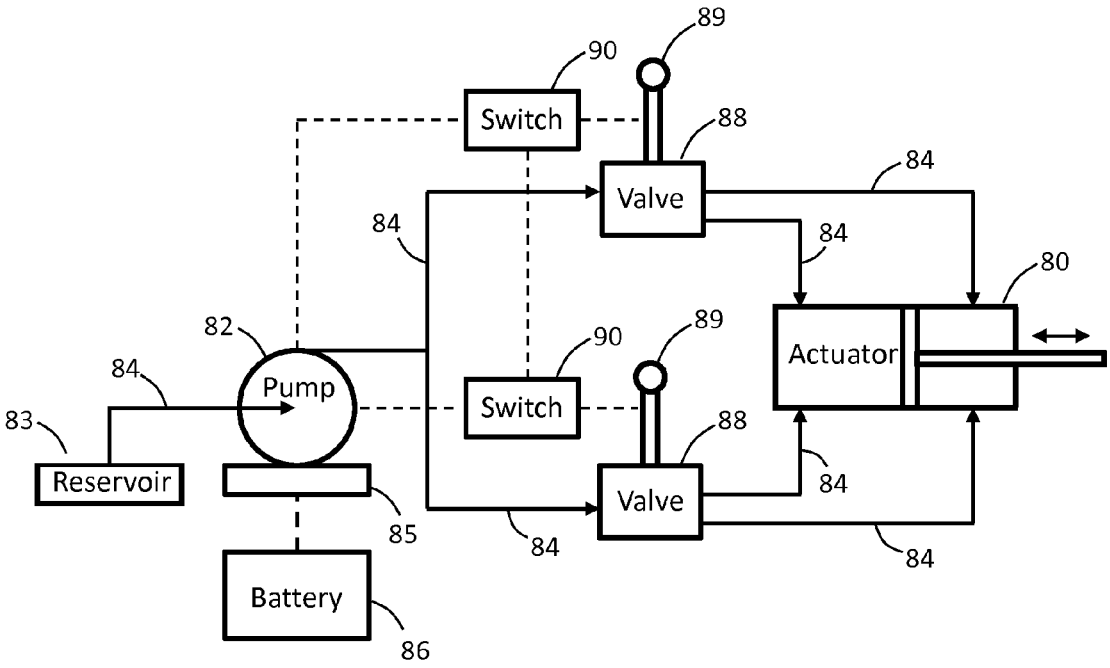
FIG. 14 is a schematic diagram of an operating system of the creeper assembly illustrated in FIG. 1.

Referring now to FIG. 14, an operating system of the creeper assembly 10 will be described. The illustrated creeper assembly 10 includes a pump 82, although such is not required. The pump 82 is configured to supply pressurized fluid to the actuator 80. For example, the pump 82 can be a hydraulic pump that is connected to the actuator 80 by a set of hoses 84. In other embodiments, however, the pump 82 can be configured to provide pressured air to the actuator 80 or, if the actuator 80 is an electric actuator, the pump 82 may not be needed altogether.

The illustrated pump 82 is powered by a motor 85. The motor 85 is preferably an electric motor but, alternatively, can be any type of motor that is configured to provide a source of power to the pump 82. As shown, a battery 86 is connected to the motor 85, although such is not required. The battery 86 can be any source of electrical power such as, for example, a rechargeable 18-volt battery or other suitable battery. The creeper assembly 10 may include any number or configuration of batteries 86 as desired. It should be appreciated that the pump 82, the reservoir 83, the motor 85, and the battery 86 can be mounted on any portion of the creeper assembly 10 such as, for example, on the rear axle 22 between the rear wheel supports 24.

The illustrated creeper assembly 10 also includes a pair of control valves 88 for selectively controlling operation of the actuator 80. As shown in FIG. 1, the control valves 88 are preferably mounted to the respective upper seat frame members 30 and are located on opposite sides of the seat 32, although such a location is not required. Referring back to FIG. 14, the illustrated control valves 88 are arranged in parallel between the pump 82 and the actuator 80 via the hoses 84 but, alternatively, can be arranged in series. As will be explained below, each of the illustrated control valves 88 is configured to selectively provide a supply of pressurized fluid (i.e. hydraulic fluid) to opposing chambers of the actuator 80 for extending or retracting the actuator 80. It should be appreciated, however, that the control valves 88 can be configured in any manner to accomplish the functions described herein and below.

The illustrated control valves 88 are respectively operated by control levers 89. The control levers 89 can be moved from an initial position to a rearward position or a forward position in order to selectively control operation of the actuator 80. For example, if the control levers 89 are moved to the rearward position, the control valves 88 direct pressurized fluid to a first chamber of the actuator 80, thereby extending the actuator 80 and raising the creeper assembly 10. Conversely, if the control levers 89 are moved to the forward position, the control valves 88 direct pressurized fluid to a second chamber of the actuator 80, thereby retracting the actuator 80 and lowering the creeper assembly 10. As such, the actuator 80 can be extended and retracted by selective movement of the control levers 89 so as to raise or lower the creeper assembly 10.

To ensure safe operation of the creeper assembly 10, the operating system can be configured such that both of the control levers 89 need to be moved in the same direction prior to operation the actuator 80. For example, electrical switches 90 can be provided on the control levers 89. The switches 90 are capable of detecting movement of the control levers 89 in the forward and rearward positions. As shown, the switches 90 can be wired in series to the motor 85 so as to form an electrical circuit. The electrical circuit remains open unless both of the control levers 89 are moved to the same operating position. However, when both of the control levers 89 are moved to the same operating position, the electrical circuit is closed and power is supplied to the motor 85. Pressurized fluid is then directed through the control valves 88 to the actuator 80, as described above. Alternatively or in addition, the control valves 88 can be arranged in series (not shown) via the hoses 84 such that both valves need to be opened in the same direction in order to allow pressurized fluid to reach the actuator 80. It should also be appreciated that the creeper assembly 10 may include only a single solenoid valve (not shown) that can be controlled by the switches 90 provided on the control levers 89. The creeper assembly 10 may further include any additional components, including but not limited to position sensors, load sensors, a controller, or the like for desired operation.

The creeper assembly 10 will now be described in the various positions. As shown in FIG. 2, the creeper assembly 10 is in the lowered lying position. In this position, the seat 32 and the backrest 36 are in a generally horizontal position at a first height H1 relative to a support surface S on which the creeper assembly 10 is located. For example, the first height H1 is preferably about 4 inches or less. However, the first height H1 can be any other desired height from the support surface S, such as approximately 6 inches, 8 inches, 10 inches, or more. The headrest 60 extends from the backrest 36 in a generally horizontal position for supporting a person's head.

As shown in FIG. 3, the creeper assembly 10 is illustrated in an intermediate position. In this position, the seat 36 is maintained in a generally horizontal position by the seat frame control arms 38, as described above. However, the backrest 36 is no longer in a horizontal position but is now in an inclined position relative to the seat 32. Further, the headrest 60 is no longer in the extended position but begins to retract, as will be further explained below.

As shown in FIG. 4, the creeper assembly 10 is illustrated in the raised seated position. In the raised seated position, the seat 32 is maintained in a generally horizontal position but is now located at a second height H2 from the support surface S on which the creeper assembly 10 is located. For example, the second height H2 can be approximately 26 inches. However, the second height H2 can be any other desired height, such as less than or greater than approximately 26 inches. The illustrated backrest 36 is inclined in a generally upright position relative to the seat 32 and the illustrated headrest 60 is retracted behind the backrest 36.

Figure 5:
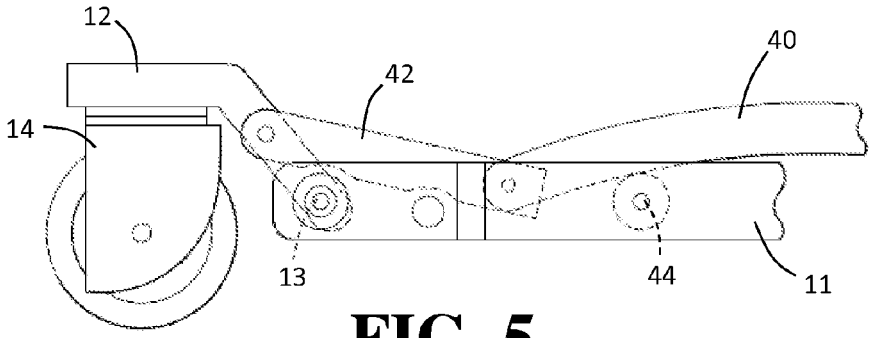
FIG. 5 is an enlarged side view of a front support leg of the creeper assembly illustrated in FIG. 1 when the creeper assembly is in the lowered lying position.
Figure 6:
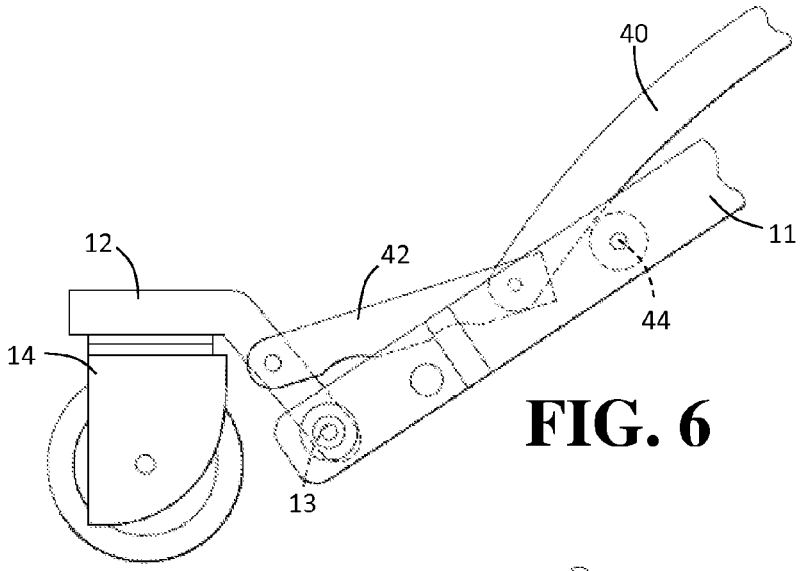
FIG. 6 is an enlarged side view of the front support leg illustrated in FIG. 5 when the creeper assembly is in the intermediate position.
Figure 7:
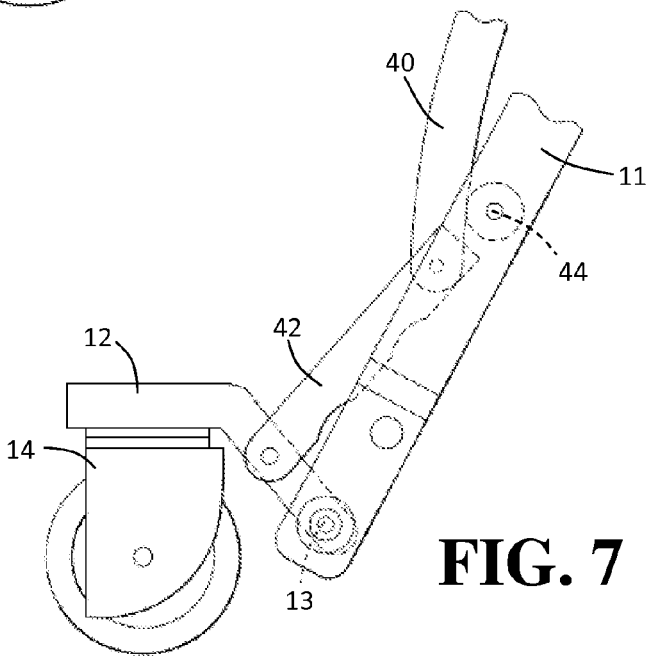
FIG. 7 is an enlarged side view of the front support leg illustrated in FIG. 6 when the creeper assembly is in the raised seated position.

Referring now to FIGS. 5 through 7, the operation of the front control arm mechanism will be described as the creeper assembly 10 is adjusted between the various positions. In the lowered lying position, as shown in FIG. 5, the front control arms 40 further extend along the main support legs 11 such that the front cam roller 44 is located near an intermediate portion of the front control arms 40. As a result, the front control arms 40 hold the front wheel support 12 in a horizontal position.

When the creeper assembly 10 is adjusted from the lowered lying position to the intermediate position, as shown in FIG. 6, the main support legs 11 and the lower seat frame members 16 begin to pivot relative to one another in a scissor-like manner (see FIG. 3). This causes the lower seat frame members 16 to pull the front control arms 40 relative to the main support legs 11. As a result, the front control arms 40 maintain the front wheel support 12 in a horizontal position as the creeper assembly 10 is adjusted to the intermediate position. The lower edges of the front control arms 40 ride along the front cam roller 44 to control positioning of the front control arms 40.

When the creeper assembly 10 is adjusted to the raised seated position, as shown in FIG. 7, the lower seat frame members 16 continue to pull the front control arms 40 relative to the mains support legs 11. For example, in this position the illustrated front cam roller 44 is located at the second end of the front control arms 40 near the front control arm links 42. As a result, the front control arms 40 continue to maintain the front wheel support 12 in a horizontal position, thus providing a stable base for the creeper assembly 10 in the various positions.

Figure 8:
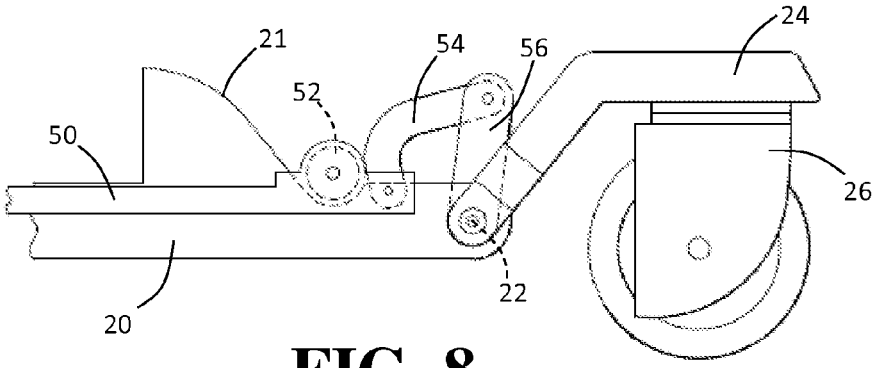
FIG. 8 is an enlarged side view of a rear support leg of the creeper assembly illustrated in FIG. 1 when the creeper assembly is in the lowered lying position.
Figure 9:
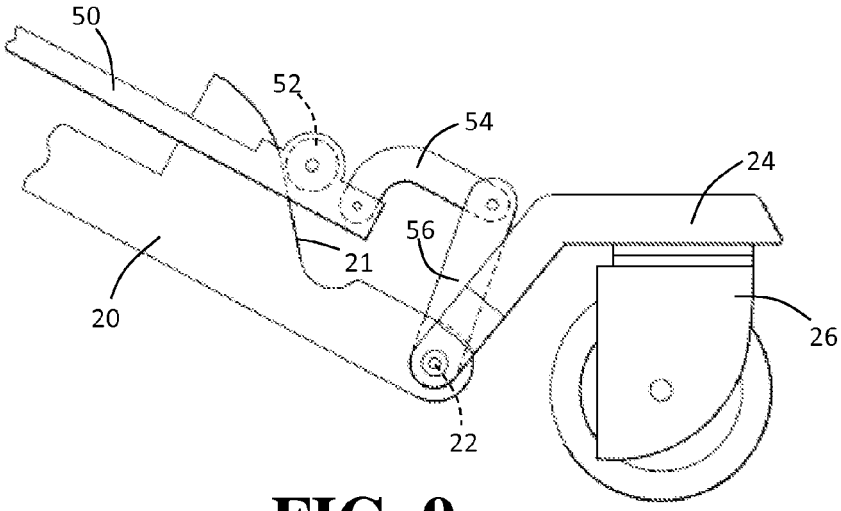
FIG. 9 is an enlarged side view of the rear support leg illustrated in FIG. 8 when the creeper assembly is in the intermediate position.
Figure 10:
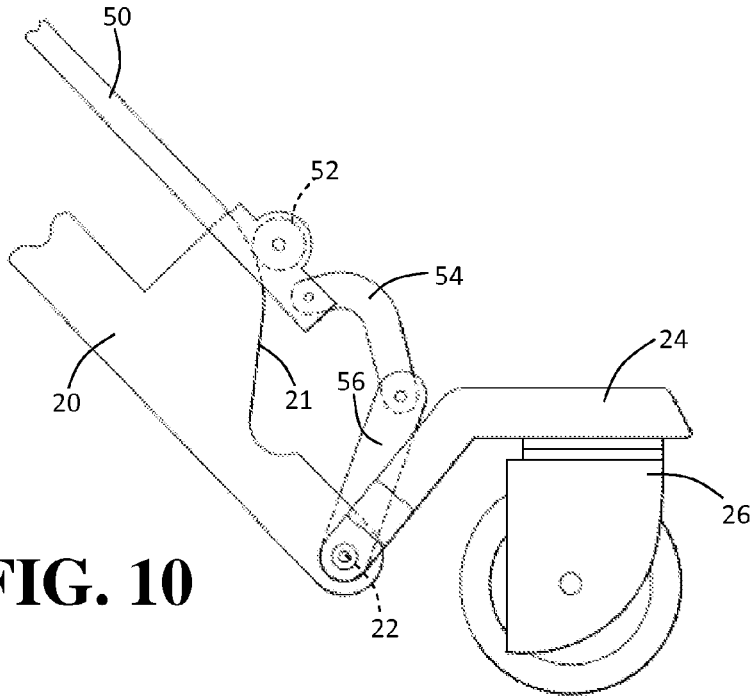
FIG. 10 is an enlarged side view of the rear support leg illustrated in FIG. 9 when the creeper assembly is in the raised seated position.

Referring now to FIGS. 8 through 10, the operation of the rear control arm mechanism will be described as the creeper assembly 10 is adjusted between the various positions. In the lowered lying position, as shown in FIG. 8, the rear control arms 50 further extend along the rear support leg 20 such that the rear cam roller 52 is located on the rear cam surface 21 nearest the rear axle 22. As a result, the rear control arms 50 hold the rear wheel supports 24 in a horizontal position.

When the creeper assembly 10 is adjusted from the lowered lying position to the intermediate position, as shown in FIG. 9, the rear support leg 20 and the main support legs 11 begin to move relative to one another in a scissor-like manner (see FIG. 3). This causes the main support legs 11 to pull the rear control arms 50 relative to the rear support leg 20. As a result, the rear control arms 50 maintain the rear wheel supports 24 in a horizontal position. The rear cam roller 52 rides along the rear cam surface 21 to control positioning of the rear control arms 50.

When the creeper assembly 10 is adjusted to the raised seated position, as shown in FIG. 10, the mains support legs 11 continue to pull the rear control arms 50 relative to the rear support leg 20. For example, in this position the illustrated rear cam roller 52 is positioned on the rear cam surface 21 furthest from the rear axle 22. As a result, the rear control arms 50 continue to maintain the rear wheel supports 24 in a horizontal position, thus providing a stable base for the creeper assembly 10 in the various positions.

Figure 11:
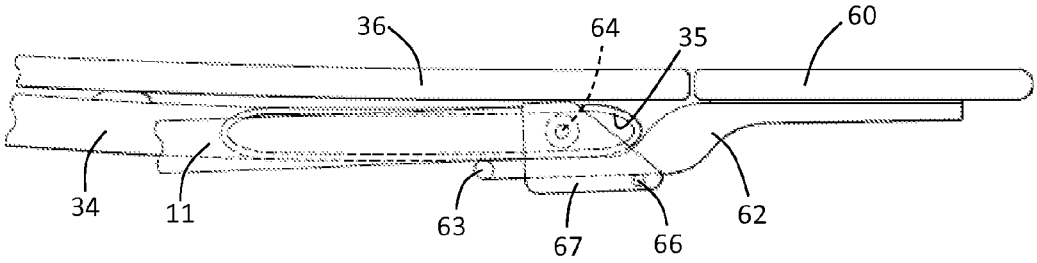
FIG. 11 is an enlarged side view of a headrest mechanism on the creeper assembly illustrated in FIG. 1 when the creeper assembly is in the lowered lying position.
Figure 12:
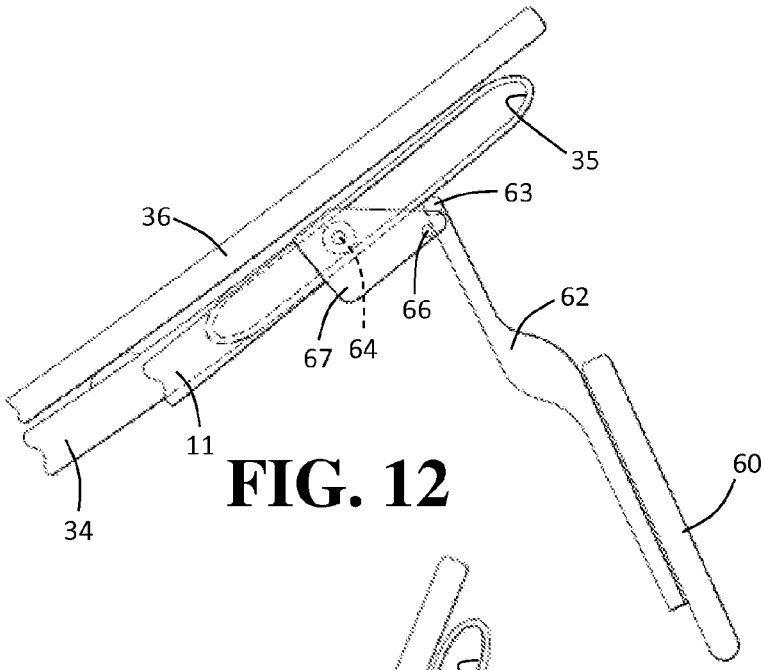
FIG. 12 is an enlarged side view of the headrest mechanism illustrated in FIG. 11 when the creeper assembly is in the intermediate position.
Figure 13:
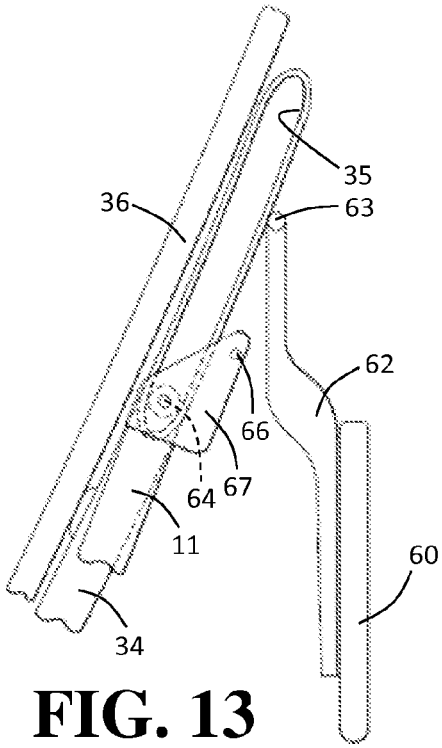
FIG. 13 is an enlarged side view of the headrest mechanism illustrated in FIG. 12 when the creeper assembly is in the raised seated position.

Referring now to FIGS. 11 through 13, the operation of the automatic headrest mechanism will be explained as the creeper assembly 10 is adjusted between the various positions. In the lowered lying position, as shown in FIG. 11, the guide member 64 is located near ends of the guide tracks 35 such that the cross bar 66 contacts the headrest support arm 62 to hold the headrest 60 in the extended position. When the creeper assembly 10 is adjusted to the intermediate position, as shown in FIG. 12, and further to the raised seated position, as shown in FIG. 13, the backrest support arms 34 begin to extend relative to the main support legs 11 such that the guide member 64 slides along the guide tracks 35 in a direction away from the extended headrest 60. As a result, the cross bar 66 also moves along the headrest support arm 62 in a direction away from the extended headrest 60. Once the cross bar 66 clears the hinge mechanism 63 of the headrest support arm 62, the headrest 60 is free to swing downwardly due to the force of gravity. Thus, the illustrated headrest 60 can be automatically moved between the extended and retracted positions as the creeper assembly 10 is adjusted between the various positions.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A creeper assembly comprising:

a frame assembly supported on a plurality of wheels for movement along a support surface, the frame assembly including a seat and a backrest that extends from the seat, the frame assembly being adjustable between a lowered lying position, wherein the seat and the backrest are in a horizontal position at a first height above the support surface, and a raised seated position, wherein the seat is in a horizontal position at a second height above the support surface that is greater than the first height and the backrest is inclined in an upright position relative to the seat; and an actuator provided on the frame assembly that is operable for adjusting the frame assembly between the lowered lying position and the raised seated position, wherein the frame assembly includes a front support leg and a rear support leg that are movable relative to one another in a pivotal manner, and wherein the front support leg is supported on a single wheel and the rear support leg is supported on a pair of wheels that are spaced apart from one another.

2. A creeper assembly comprising:

a frame assembly supported on a plurality of wheels for movement along a support surface, the frame assembly including a seat and a backrest that extends from the seat, the frame assembly being adjustable between a lowered lying position, wherein the seat and the backrest are in a horizontal position at a first height above the support surface, and a raised seated position, wherein the seat is in a horizontal position at a second height above the support surface that is greater than the first height and the backrest is inclined in an upright position relative to the seat; and an actuator provided on the frame assembly that is operable for adjusting the frame assembly between the lowered lying position and the raised seated position, wherein a caster wheel is attached to a front wheel support that is in turn pivotally attached to the front support leg, and wherein the front wheel support is maintained in a horizontal position relative to the support surface by a front control arm mechanism that is provided between the front wheel support and a portion of the frame assembly that is movable relative to the front support leg.

3. The creeper assembly of claim 2, wherein the front control arm mechanism includes a front control arm that rides along a front cam roller that is provided on the front support leg.

4. A creeper assembly comprising:

a frame assembly supported on a plurality of wheels for movement along a support surface, the frame assembly including a seat and a backrest that extends from the seat, the frame assembly being adjustable between a lowered lying position, wherein the seat and the backrest are in a horizontal position at a first height above the support surface, and a raised seated position, wherein the seat is in a horizontal position at a second height above the support surface that is greater than the first height and the backrest is inclined in an upright position relative to the seat; and an actuator provided on the frame assembly that is operable for adjusting the frame assembly between the lowered lying position and the raised seated position, wherein the frame assembly includes a front support leg and a rear support leg that are movable relative to one another in a pivotal manner, and wherein a rear axle having a pair of rear wheel supports is mounted for rotation on the rear support leg, and a pair of caster wheels are respectively attached to the rear wheel supports.

5. The creeper assembly of claim 4, wherein the rear wheel supports are maintained in a horizontal position relative to the support surface by a rear control arm mechanism that is provided between the rear axle and a portion of the frame assembly that is movable relative to the rear support leg.

6. The creeper assembly of claim 5, wherein the rear control arm mechanism includes a rear cam roller that rides along a rear cam surface provided on the rear support leg.

7. A creeper assembly comprising:

a frame assembly supported on a plurality of wheels for movement along a support surface, the frame assembly including a seat and a backrest that extends from the seat, the frame assembly being adjustable between a lowered lying position, wherein the seat and the backrest are in a horizontal position at a first height above the support surface, and a raised seated position, wherein the seat is in a horizontal position at a second height above the support surface that is greater than the first height and the backrest is inclined in an upright position relative to the seat; and an actuator provided on the frame assembly that is operable for adjusting the frame assembly between the lowered lying position and the raised seated position, wherein the frame assembly includes a front support leg and a rear support leg that are movable relative to one another in a pivotal manner, and wherein a lower seat frame member is pivotally attached to the front support leg, an upper seat frame member is pivotally attached to the lower seat frame member, and the seat is supported on the upper seat frame member.

8. The creeper assembly of claim 7, wherein a seat frame control arm is provided between the front support leg and the upper seat frame member to maintain the seat in a horizontal position relative to the support surface.

9. A creeper assembly comprising:

a frame assembly supported on a plurality of wheels for movement along a support surface, the frame assembly including a seat and a backrest that extends from the seat, the frame assembly being adjustable between a lowered lying position, wherein the seat and the backrest are in a horizontal position at a first height above the support surface, and a raised seated position, wherein the seat is in a horizontal position at a second height above the support surface that is greater than the first height and the backrest is inclined in an upright position relative to the seat;

an actuator provided on the frame assembly that is operable for adjusting the frame assembly between the lowered lying position and the raised seated position; and a headrest that is pivotally attached to the frame assembly for movement between an extended position and a retracted position relative to the backrest.

10. The creeper assembly of claim 9 further including an automatic headrest mechanism that extends the headrest relative to the backrest when the frame assembly is in the lowered lying position and that retracts the headrest when the frame assembly is in the raised seated position.

11. A creeper assembly comprising:

a frame assembly supported on a plurality of wheels for movement along a support surface, the frame assembly including a seat and a backrest that extends from the seat, the frame assembly being adjustable between a lowered lying position, wherein the seat and the backrest are in a horizontal position at a first height above the support surface, and a raised seated position, wherein the seat is in a horizontal position at a second height above the support surface that is greater than the first height and the backrest is inclined in an upright position relative to the seat;

an actuator provided on the frame assembly that is operable for adjusting the frame assembly between the lowered lying position and the raised seated position; and a pump that is connected to the actuator by hoses for providing a supply of pressurized fluid to the actuator.

12. The creeper assembly of claim 11, wherein the pump is powered by an electric motor that is in turn powered by a battery.

13. The creeper assembly of claim 12 further including a pair of control valves that are connected between the pump and the actuator to control flow of the pressurized fluid to the actuator for selectively extending and retracting the actuator.

14. The creeper assembly of claim 13, wherein the control valves are operable by control levers for movement between a first operating position and a second operating position for selectively extending and retracting the actuator.

15. The creeper assembly of claim 14, wherein the control levers include switches that form an electrical circuit with the motor, and the electrical circuit is configured such that both control levers must be moved in the same operating position before power is provided to the motor.

16. The creeper assembly of claim 1 further including at least one spring member that is configured to bias the frame assembly in the raised seated position.

17. A creeper assembly comprising:

a frame assembly having at least one front support leg and at least one rear support leg that are movable relative to one another in a pivotal manner and supported on a plurality of wheels, the frame assembly further including a seat and a backrest that extends from the seat, the frame assembly being adjustable between a lowered lying position and a raised seated position;

an actuator provided on the frame assembly that is operable for adjusting the frame assembly between the lowered lying position and the raised seated position; and a pair of control levers provided on the frame assembly that must both be moved for selectively controlling operation of the actuator.

* * * * *